US010755663B2

(12) United States Patent
Pyun et al.

(10) Patent No.: US 10,755,663 B2
(45) Date of Patent: Aug. 25, 2020

(54) DISPLAY PANEL DRIVER AND DISPLAY APPARATUS HAVING THE SAME

(71) Applicant: Samsung Display Co., Ltd., Yongin-Si, Gyeonggi-Do (KR)

(72) Inventors: Kihyun Pyun, Gwangmyeong-si (KR); Yunmi Kim, Changwon-si (KR); Sung-Jun Kim, Hwaseong-si (KR); Juhyun Kim, Hwaseong-si (KR); Minyoung Park, Busan (KR); Heebum Park, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 97 days.

(21) Appl. No.: 15/981,239

(22) Filed: May 16, 2018

(65) Prior Publication Data

US 2019/0057667 A1 Feb. 21, 2019

(30) Foreign Application Priority Data

Aug. 17, 2017 (KR) ..... 10-2017-0103933

(51) Int. Cl.
*G09G 3/36* (2006.01)

(52) U.S. Cl.
CPC ..... *G09G 3/3688* (2013.01); *G09G 3/3677* (2013.01); *G09G 2300/0857* (2013.01); *G09G 2310/027* (2013.01); *G09G 2310/0243* (2013.01); *G09G 2310/0291* (2013.01); *G09G 2310/0294* (2013.01); *G09G 2310/08* (2013.01); *G09G 2320/02* (2013.01); *G09G 2330/02* (2013.01); *G09G 2330/08* (2013.01); *G09G 2370/08* (2013.01)

(58) Field of Classification Search
CPC ..... G09G 3/3688; G09G 3/3677; G09G 2300/0857; G09G 2310/0243; G09G 2310/027; G09G 2310/0291; G09G 2310/0294; G09G 2310/08; G09G 2330/02
See application file for complete search history.

(56) References Cited

U.S. PATENT DOCUMENTS

2007/0014344 A1* 1/2007 Maangat ..... H04B 3/04 375/229
2015/0365075 A1 12/2015 Kawa et al.
2016/0043860 A1* 2/2016 Tu ..... H03L 7/087 375/371
2016/0189621 A1* 6/2016 Kim ..... G09G 3/3258 345/215
2016/0248521 A1 8/2016 Streshinsky et al.
2017/0083384 A1 3/2017 Stocker et al.
2018/0190238 A1* 7/2018 Park ..... G09G 5/008

FOREIGN PATENT DOCUMENTS

KR 1020140090736 A 7/2014

* cited by examiner

*Primary Examiner* — Robert J Michaud
(74) *Attorney, Agent, or Firm* — Cantor Colburn LLP

(57) ABSTRACT

A display panel driver includes a timing controller and a data driver. The timing controller generates a data signal based on an input image data. The data driver receives the data signal, converts the data signal into a data voltage and outputs the data voltage to a display panel. The data signal includes positive data and negative data. The data driver includes a data skew compensating circuit which samples the positive data using the negative data and compensates a skew of the data signal.

20 Claims, 10 Drawing Sheets

DISPLAY PANEL DRIVER AND DISPLAY APPARATUS HAVING THE SAME

This application claims priority to Korean Patent Application No. 10-2017-0103933, filed on Aug. 17, 2017, and all the benefits accruing therefrom under 35 U.S.C. § 119, the content of which in its entirety is herein incorporated by reference.

BACKGROUND

1. Field

Exemplary embodiments of the inventive concept relate to a display panel driver and a display apparatus including the display panel driver. More particularly, exemplary embodiments of the inventive concept relate to a display panel driver enhancing accuracy of data and a display apparatus including the display panel driver.

2. Description of the Related Art

Generally, a display apparatus includes a display panel and a display panel driver. The display panel includes a plurality of gate lines, a plurality of data lines and a plurality of pixels. The pixels are connected to the gate lines and the data lines. The display panel driver includes a gate driver providing gate signals to the gate lines, a data driver providing data voltages to the data lines and a timing controller controlling driving timings of the gate driver and the data driver.

The timing controller outputs the data signals to the data driver. The timing controller may transmit the data signal having positive data and negative data.

SUMMARY

The data signal may be distorted due to characteristics and performances of a transmitter driver of the timing controller and transmission differences of data transmitting paths of the positive data and the negative data. In addition, due to the distortion of the data signal, the display quality of the display panel may be deteriorated.

Exemplary embodiments of the inventive concept provide a display panel driver enhancing accuracy of a data signal and enhancing a display quality of a display panel.

Exemplary embodiments of the inventive concept also provide a display apparatus including the above-mentioned display panel driver.

According to an exemplary embodiment of the inventive concept, a display panel driver includes a timing controller and a data driver. The timing controller generates a data signal based on an input image data. The data driver receives the data signal, converts the data signal into a data voltage and outputs the data voltage to a display panel. The data signal includes positive data and negative data. The data driver includes a data skew compensating circuit which samples the positive data using the negative data and compensates a skew of the data signal.

In an exemplary embodiment, the data driver may further include a receiver equalizer which receives the data signal and compensates a gain of the data signal, a clock-data restoring circuit which generates a sampling clock to restore the data signal received from the receiver equalizer and restores the data signal using the sampling clock, a digital to analog converter which converts the restored data signal to the data voltage and a data output buffer part which outputs the data voltage to the display panel.

In an exemplary embodiment, the data skew compensating circuit may include a data skew detector which compares a timing of the positive data and a timing of converted negative data to detect the skew of the data signal and generates one of an increase signal and a decrease signal based on the skew of the data signal, a charge pump which increases or decreases a voltage of a first node based on the one of the increase signal and the decrease signal, a loop filter which maintains the voltage of the first node and a voltage control delaying circuit which delays the negative data and generates the converted negative data as a delayed signal of the negative data.

In an exemplary embodiment, the data skew detector may include a plurality of flip flops which sample the positive data using the converted negative data.

In an exemplary embodiment, the data skew detector may include a first D-flip flop comprising a first input part which receives the positive data, a second input part which receives the converted negative data and an output part which outputs a first logic signal, a second D-flip flop comprising a first input part which receives the positive data, a second input part which receives the converted negative data and an output part which outputs a second logic signal, a third D-flip flop comprising a first input part which receives the first logic signal, a second input part which receives the converted negative data and an output part which outputs a third logic signal, and a fourth D-flip flop comprising a first input part which receives the second logic signal, a second input part which receives the converted negative data and an output part which outputs a fourth logic signal. The data skew detector may further comprise a first XOR gate which receives the first logic signal and the third logic signal and a second XOR gate which receives the second logic signal and the fourth logic signal.

In an exemplary embodiment, the data skew detector may further include a fifth D-flip flop comprising a first input part which receives the decrease signal which is an output signal of the first XOR gate, a second input part which receives a compensated clock signal and an output part which outputs the decrease signal which is sampled by the compensated clock signal and a sixth D-flip flop comprising a first input part which receives the increase signal which is an output signal of the second XOR gate, a second input part which receives the compensated clock signal and an output part which outputs the increase signal which is sampled by the compensated clock signal.

In an exemplary embodiment, the charge pump may include a first switch which is operated in response to the increase signal, a first current source disposed between the first switch and a power voltage node, a second switch which is operated in response to the decrease signal and a second current source disposed between the second switch and a ground.

In an exemplary embodiment, the loop filter may include a first capacitor including a first end connected to the first node and a second end connected to a ground.

In an exemplary embodiment, the voltage control delaying circuit may include even-numbered inverter circuits connected to each other.

In an exemplary embodiment, the inverter circuit may include a first transistor and a second transistor connected to each other in series. The first transistor may include a control electrode connected to a control electrode of the second transistor, an input electrode connected to the first node and an output electrode connected to an input electrode of the second transistor. The second transistor may include the control electrode connected to the control electrode of the first transistor, the input electrode connected to the output electrode of the first transistor and an output electrode connected to a ground.

In an exemplary embodiment, the data skew compensating circuit may be disposed between a transmitting path connecting the timing controller and the data driver and the receiver equalizer.

In an exemplary embodiment, the data skew compensating circuit may be disposed between the receiver equalizer and the clock-data restoring circuit.

According to an exemplary embodiment of the inventive concept, a display apparatus includes a display panel, a timing controller, a gate driver and a data driver. The display panel displays an image. The timing controller generates a first control signal and a second control signal based on an input control signal and generates a data signal based on input image data. The gate driver receives the first control signal, generates a gate signal in response to the first control signal and provides the gate signal to the display panel. The data driver receives the second control signal and the data signal, converts the data signal to a data voltage in response to the second control signal and provides the data voltage to the display panel. The data signal includes positive data and negative data. The data driver includes a data skew compensating circuit which samples the positive data using the negative data and compensates a skew of the data signal.

In an exemplary embodiment, the data driver may further include a receiver equalizer which receives the data signal and compensates a gain of the data signal, a clock-data restoring circuit which generates a sampling clock to restore the data signal received from the receiver equalizer and restores the data signal using the sampling clock, a digital to analog converter which converts the restored data signal to the data voltage and a data output buffer part which outputs the data voltage to the display panel.

In an exemplary embodiment, the data skew compensating circuit may include a data skew detector which compares a timing of the positive data and a timing of converted negative data to detect the skew of the data signal and generates one of an increase signal and a decrease signal based on the skew of the data signal, a charge pump which increases or decreases a voltage of a first node based on the one of the increase signal and the decrease signal, a loop filter which maintains the voltage of the first node and a voltage control delaying circuit which delays the negative data to generate the converted negative data as a delayed signal of the negative data.

In an exemplary embodiment, the data skew detector may include a plurality of flip flops which sample the positive data using the converted negative data.

In an exemplary embodiment, the plurality of data skew detector may include a first D-flip flop comprising a first input part which receives the positive data, a second input part which receives the converted negative data and an output part which outputs a first logic signal, a second D-flip flop comprising a first input part which receives the positive data, a second input part which receives the converted negative data and an output part which outputs a second logic signal, a third D-flip flop comprising a first input part which receives the first logic signal, a second input part which receives the converted negative data and an output part which outputs a third logic signal, and a fourth D-flip flop comprising a first input part which receives the second logic signal, a second input part which receives the converted negative data and an output part which outputs a fourth logic signal The data skew detector may further comprise a first XOR gate which receives the first logic signal and the third logic signal and a second XOR gate which receives the second logic signal and the fourth logic signal.

In an exemplary embodiment, the data skew detector may further include a fifth D-flip flop comprising a first input part which receives the decrease signal which is an output signal of the first XOR gate, a second input part which receives a compensated clock signal and an output part which outputs the decrease signal which is sampled by the compensated clock signal and a sixth D-flip flop comprising a first input part which receives the increase signal which is an output signal of the second XOR gate, a second input part which receives the compensated clock signal and an output part which outputs the increase signal which is sampled by the compensated clock signal.

In an exemplary embodiment, the charge pump may include a first switch which is operated in response to the increase signal, a first current source disposed between the first switch and a power voltage node, a second switch which is operated in response to the decrease signal and a second current source disposed between the second switch and a ground.

In an exemplary embodiment, the voltage control delaying circuit may include even-numbered inverter circuits connected to each other.

According to the display panel driver and the display apparatus including the display panel driver, the data driver includes a data skew compensating circuit such that the distortion of the data signal due to characteristics and performances of a transmitter driver of the timing controller and transmission differences of data transmitting paths of the positive data and the negative data may be compensated.

In addition, the distortion of the data signal is compensated so that the display quality of the display panel may be enhanced.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Hereinafter, the inventive concept will be explained in detail with reference to the accompanying drawings.

Figure 1:
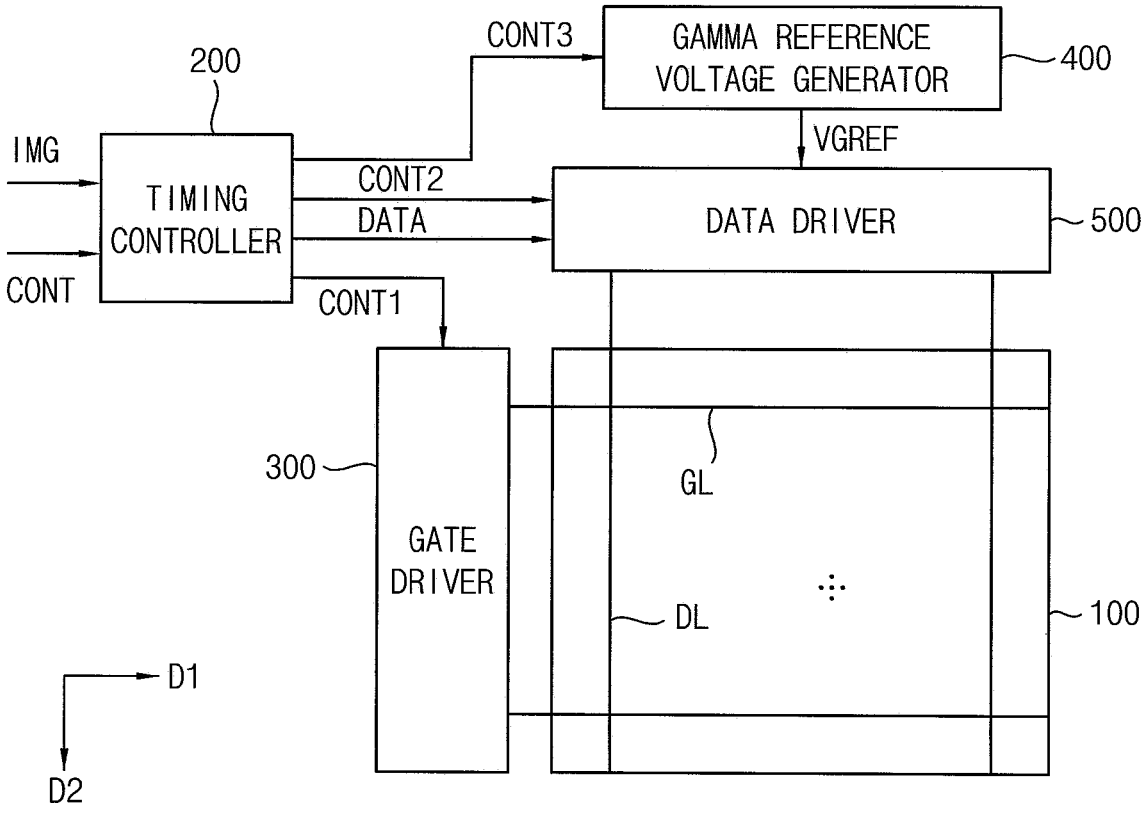
FIG. 1 is a block diagram illustrating an exemplary embodiment of a display apparatus according to the inventive concept.

FIG. 1 is a block diagram illustrating an exemplary embodiment of a display apparatus according to the inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 includes a display region and a peripheral region adjacent to the display region.

The display panel 100 includes a plurality of gate lines GL, a plurality of data lines DL and a plurality of unit pixels electrically connected to the gate lines GL and the data lines DL. The gate lines GL extend in a first direction D1 and the data lines DL extend in a second direction D2 crossing the first direction D1.

Each unit pixel includes a switching element (not shown) and a liquid crystal capacitor (not shown) and a storage capacitor (not shown). The liquid crystal capacitor and the storage capacitor are electrically connected to the switching element. The unit pixels may be disposed in a matrix form.

The timing controller 200 receives input image data IMG and an input control signal CONT from an external apparatus (not shown). The input image data IMG may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100 or may be connected to the display panel 100 in a type of a tape carrier package ("TCP"). Alternatively, the gate driver 300 may be integrated in the peripheral region of the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages of an analog type using the gamma reference voltages VGREF. The data driver 500 outputs the data voltages to the data lines DL.

The data driver 500 may be directly mounted on the display panel 100 or may be connected to the display panel 100 in a type of the TCP. Alternatively, the data driver 500 may be integrated in the peripheral region of the display panel 100.

Figure 2:
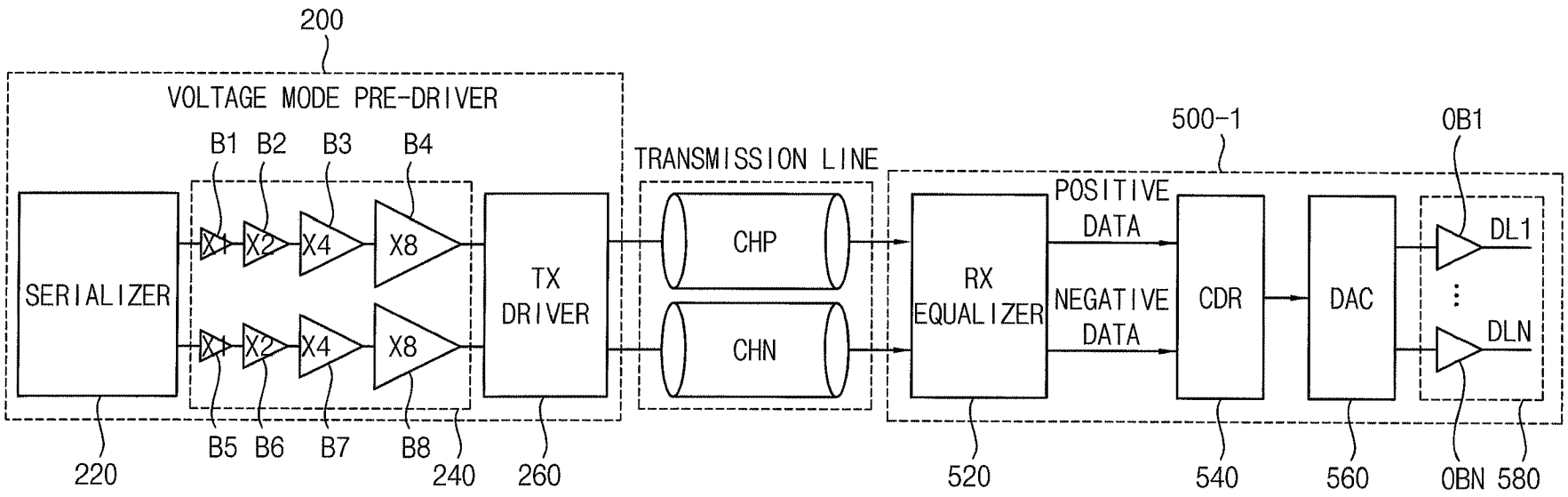
FIG. 2 is a block diagram illustrating a timing controller and a data driver without a data skew compensating circuit.

FIG. 2 is a block diagram illustrating the timing controller 200 and the data driver 500-1 without a data skew compensating circuit.

Referring to FIGS. 1 and 2, the timing controller 200 may include a pre-driver to output the data signal DATA to the data driver 500-1. The data driver 500-1 does not have a data skew compensating circuit.

In FIG. 2, the timing controller 200 may include a voltage mode pre-driver. The voltage mode pre-driver may include a serializer 220, an amplifying part 240 and a transmitter driver 260.

The serializer 220 serializes the data signal DATA which is provided to the data driver 500-1.

The amplifying part 240 may include a plurality of amplifiers B1 to B8. Since the voltage mode pre-driver is operated in a single end mode, the amplifying part 240 may include the amplifiers disposed in two rows.

The amplifiers B1 to B4 in a first row may amplify a positive component of the data signal DATA. For example, a first amplifier B1 in the first row may transmit the positive component of the data signal DATA in the same amplitude. A second amplifier B2 in the first row may amplify the positive component of the data signal DATA by two times. A third amplifier B3 in the first row may amplify the positive component of the data signal DATA by four times. A fourth amplifier B4 in the first row may amplify the positive component of the data signal DATA by eight times.

The amplifiers B5 to B8 in a second row may amplify a negative component of the data signal DATA. For example, a first amplifier B5 in the second row may transmit the negative component of the data signal DATA in the same amplitude. A second amplifier B6 in the second row may amplify the negative component of the data signal DATA by two times. A third amplifier B7 in the second row may amplify the negative component of the data signal DATA by four times. A fourth amplifier B8 in the second row may amplify the negative component of the data signal DATA by eight times.

The transmitter driver 260 transmits the amplified positive data of the data signal DATA to the data driver 500-1 through a positive channel CHP.

The transmitter driver 260 transmits the amplified negative data of the data signal DATA to the data driver 500-1 through a negative channel CHN.

The data driver 500-1 receives the positive data through the positive channel CHP and receives the negative data through the negative channel CHN. The data driver 500-1 restores the received data signal and converts the data signal of a digital type to the analog data voltage and outputs the analog data voltage to the display panel 100. The structure and the operation of the data driver 500-1 are explained referring to FIGS. 5 to 8 in detail.

Figure 3:
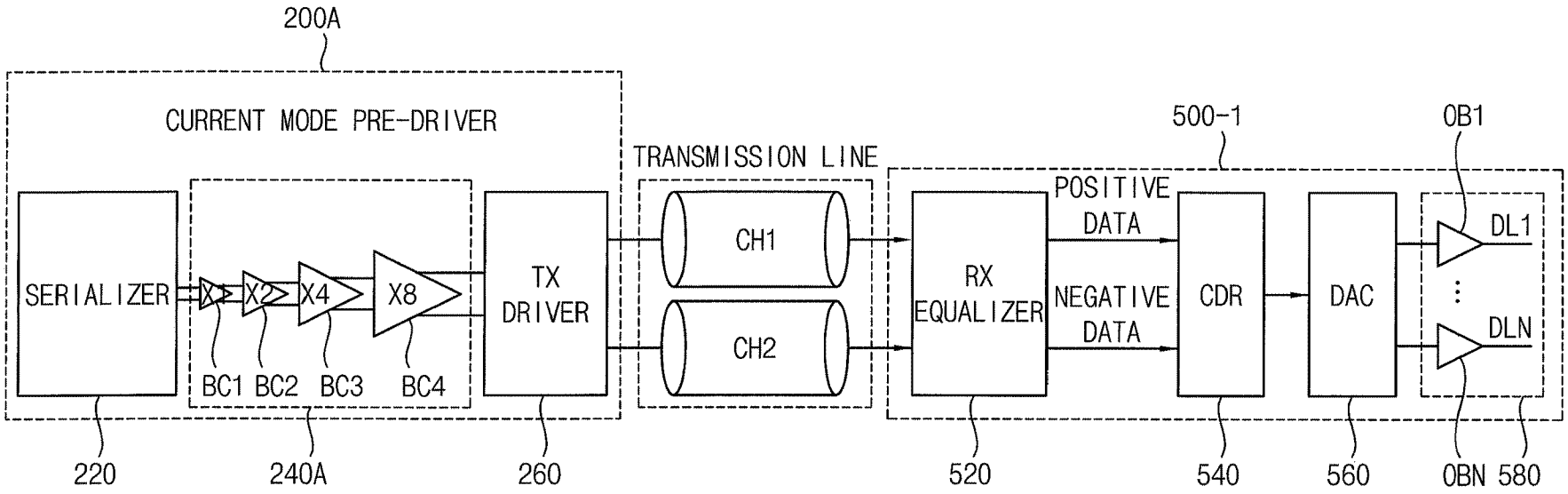
FIG. 3 is a block diagram illustrating another timing controller and the above data driver without a data skew compensating circuit.

FIG. 3 is a block diagram illustrating the timing controller 200A and the data driver 500-1 without the data skew compensating circuit.

Referring to FIGS. 1 and 3, the timing controller 200A may include a pre-driver to output the data signal DATA to the data driver 500-1.

In FIG. 3, the timing controller 200A may include a current mode pre-driver. The current mode pre-driver may include a serializer 220, an amplifying part 240A and a transmitter driver 260.

The serializer 220 serializes the data signal DATA which is provided to the data driver 500-1.

The amplifying part 240A may include a plurality of amplifiers BC1 to BC4. Since the current mode pre-driver is operated in a differential mode, the amplifying part 240A may include the amplifiers disposed in a single row.

The amplifiers BC1 to BC4 may amplify a positive component of the data signal DATA and a negative component of the data signal DATA. For example, a first amplifier BC1 may transmit the positive component of the data signal DATA and the negative component of the data signal DATA in the same amplitude. A second amplifier BC2 may amplify the positive component of the data signal DATA and the negative component of the data signal DATA by two times. A third amplifier BC3 may amplify the positive component of the data signal DATA and the negative component of the data signal DATA by four times. A fourth amplifier BC4 may amplify the positive component of the data signal DATA and the negative component of the data signal DATA by eight times.

The transmitter driver 260 transmits the amplified positive data of the data signal DATA to the data driver 500-1 through a positive channel CHP.

The transmitter driver 260 transmits the amplified negative data of the data signal DATA to the data driver 500-1 through a negative channel CHN.

Figure 4:
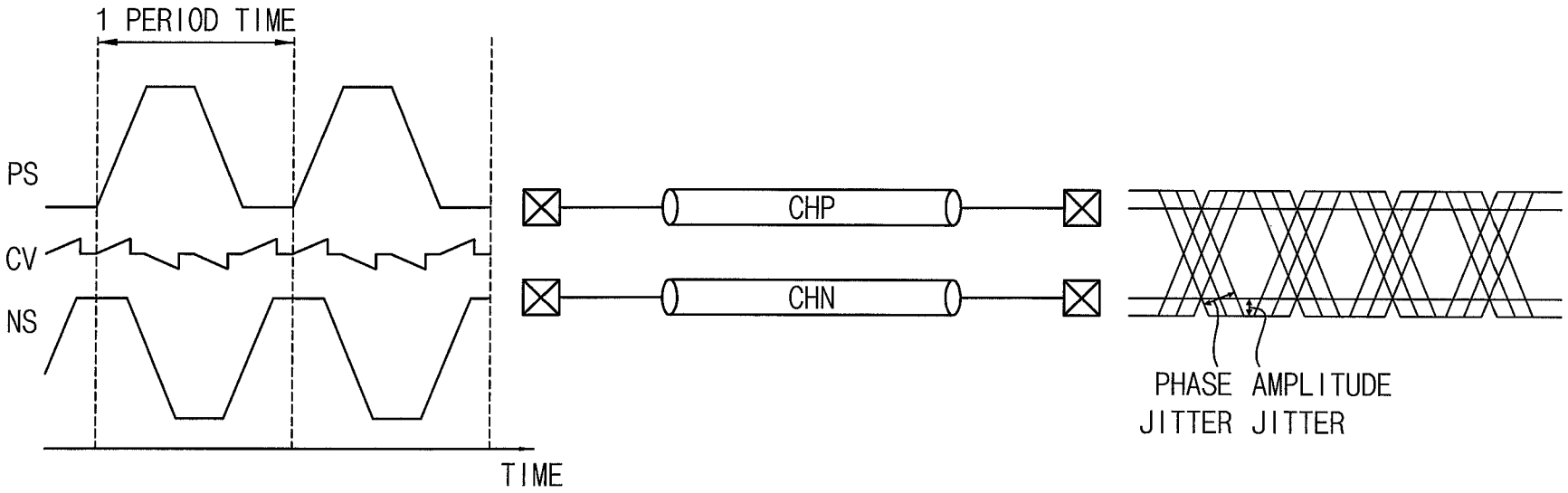
FIG. 4 is a waveform diagram illustrating a data signal output from the timing controller of FIGS. 2 and 3 and a data signal received at the data driver of FIGS. 2 and 3.

FIG. 4 is a waveform diagram illustrating a data signal output from the timing controller 200 and 200A of FIGS. 2 and 3 and a data signal received at the data driver 500-1 of FIGS. 2 and 3.

Referring to FIGS. 1 to 4, as a resolution of the display panel 100, a frame rate and a color depth increase, a unit interval (1 period time) for signal transmission decreases. When the unit interval decreases, a skew between the positive data and the negative data may significantly affect the display quality of the display panel 100.

For example, the characteristics and the performances of the transmitter driver 260 of FIGS. 2 and 3 may affect the difference between the output waveform and the output timing of the positive data and the output waveform and the output timing of the negative data.

For another example, the difference between a length of a transmitting path CHP of the positive data and a length of a transmitting path CHN of the negative data may affect the difference between the output waveform and the output timing of the positive data and the output waveform and the output timing of the negative data.

Due to the difference between the positive data PS and the negative data NS, a reference voltage CV may have a ripple. When the reference voltage CV has the ripple, a phase jitter and an amplitude jitter may be generated in the data driver 500-1 which receives the data signal DATA.

Due to the phase jitter and the amplitude jitter of the restored data in the data driver 500-1, the data signal DATA may hit a mask of an eye-diagram or the data signal DATA may have a bit error.

Figure 5:
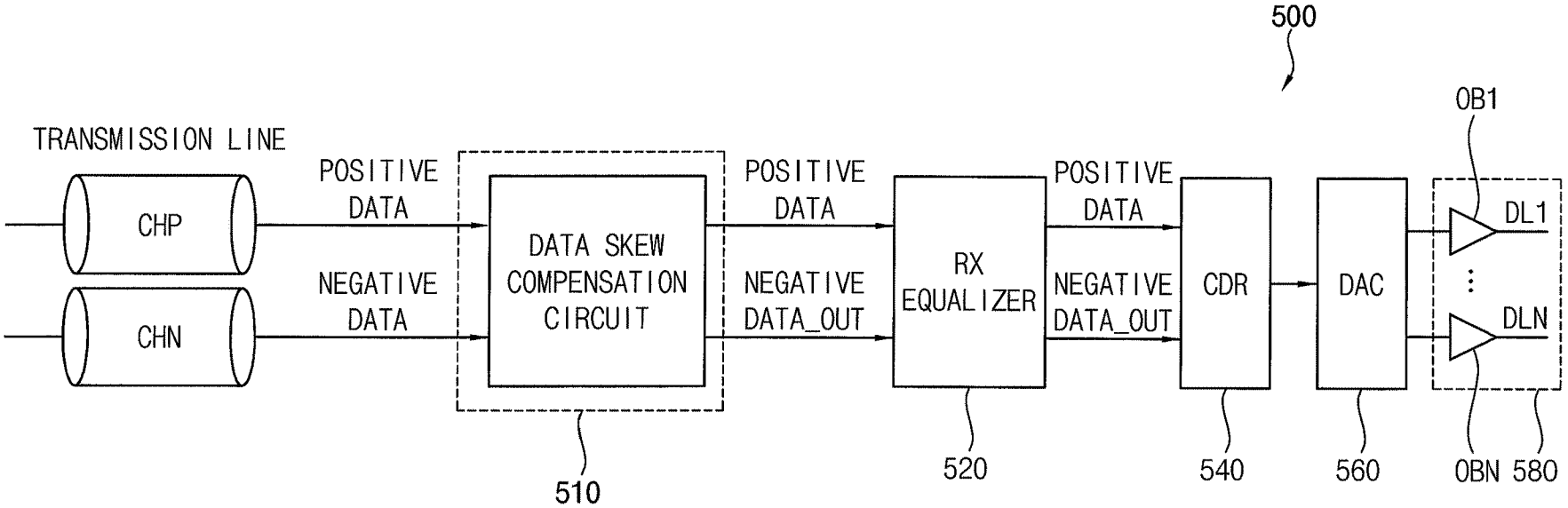
FIG. 5 is a block diagram illustrating an exemplary embodiment of the data driver of FIG. 1 including the data skew compensating circuit according to the invention.
Figure 6:
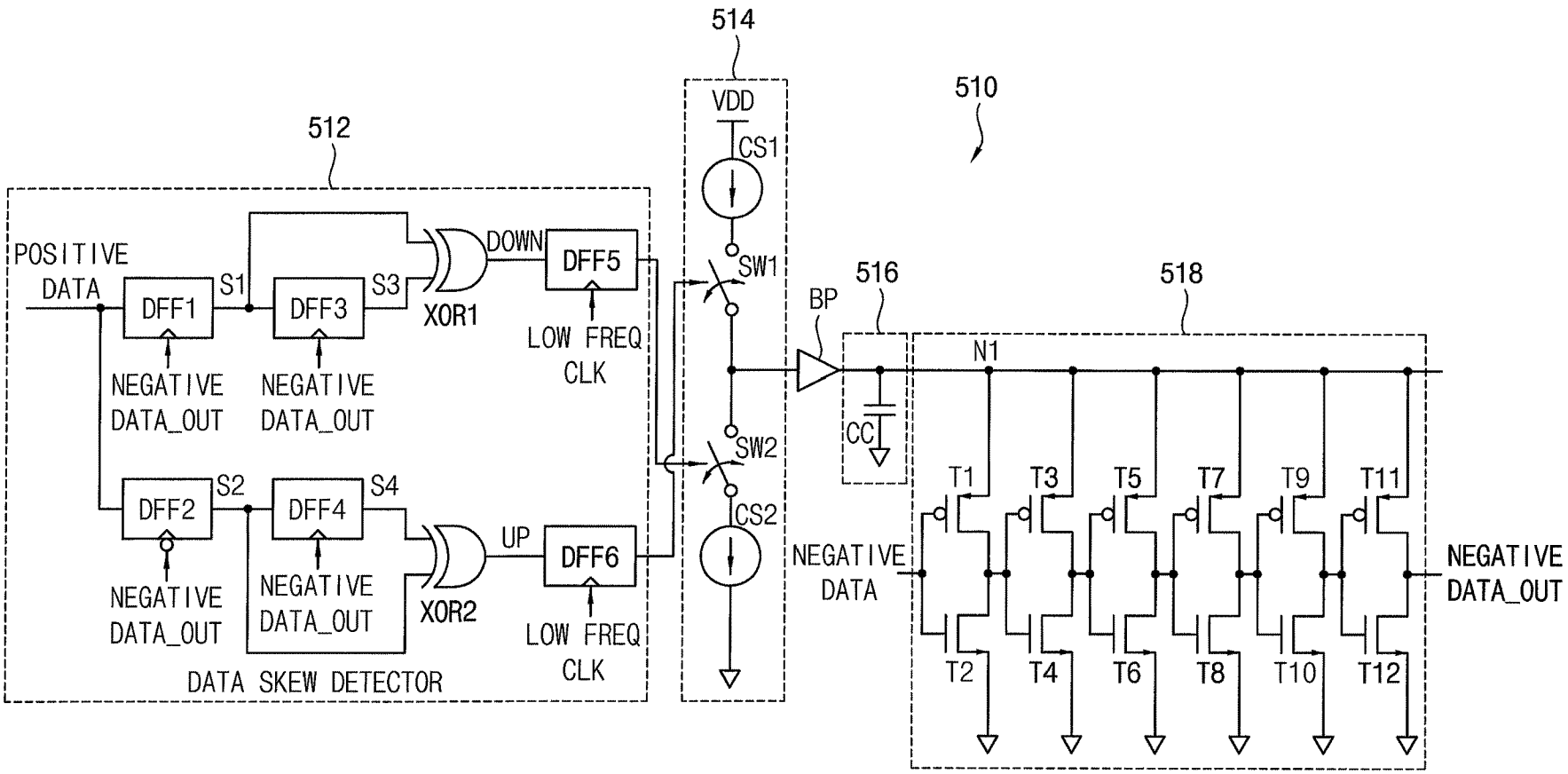
FIG. 6 is a circuit diagram illustrating an exemplary embodiment of the data skew compensating circuit of FIG. 5 according to the invention.
Figure 7:
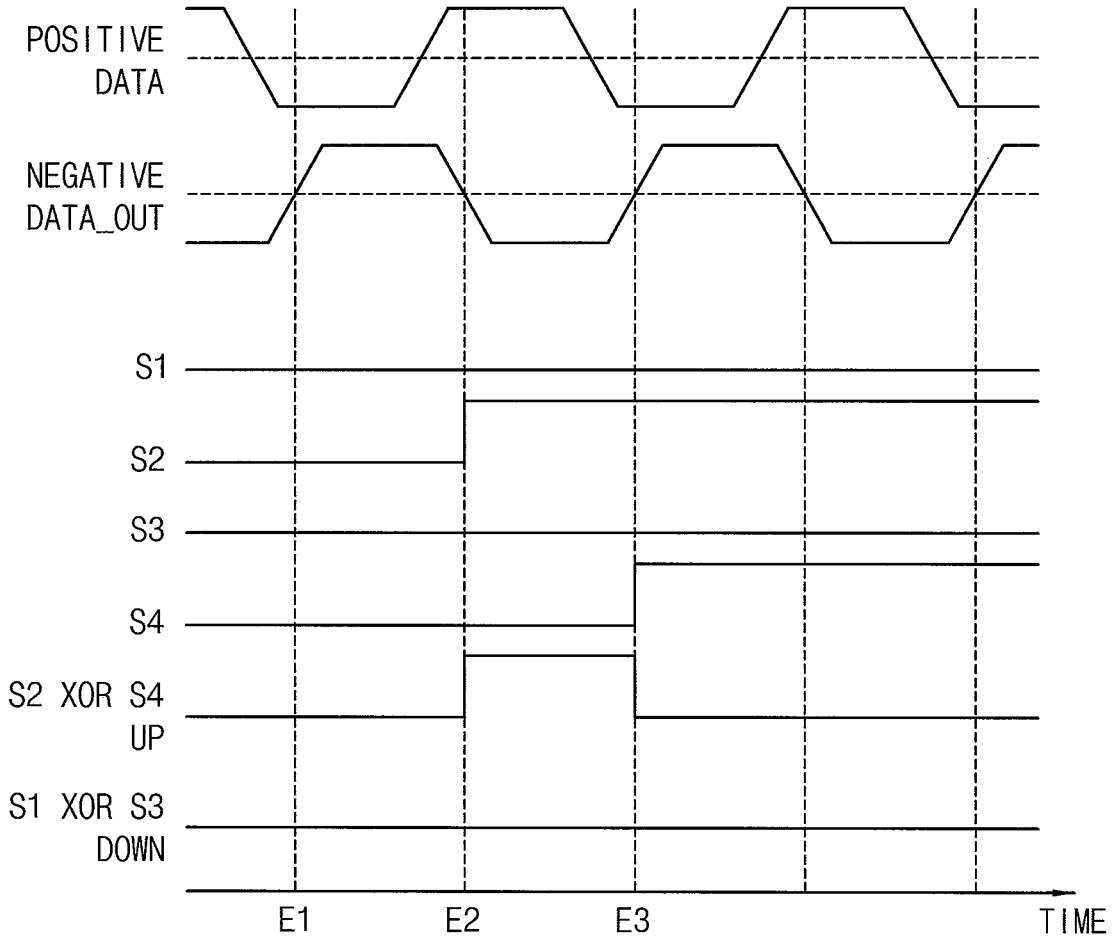
FIG. 7 is a waveform diagram illustrating an exemplary embodiment of an operation of the data skew compensating circuit of FIG. 5 according to the invention when the negative data is delayed with respect to the positive data.
Figure 8:
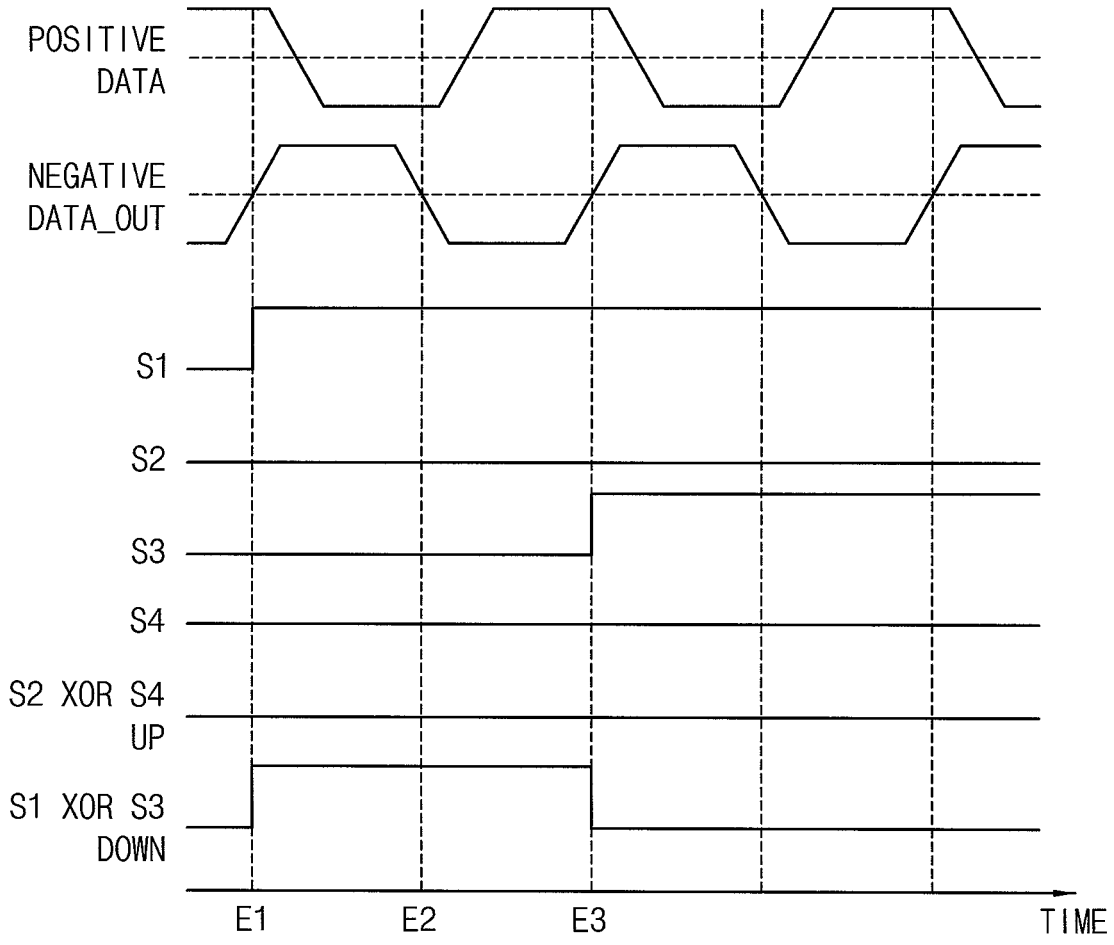
FIG. 8 is a waveform diagram illustrating an exemplary embodiment of an operation of the data skew compensating circuit of FIG. 5 according to the invention when the positive data is delayed with respect to the negative data.

FIG. 5 is a block diagram illustrating an exemplary embodiment of the data driver 500 including the data skew compensating circuit according to the invention. FIG. 6 is a circuit diagram illustrating an exemplary embodiment of the data skew compensating circuit 510 of FIG. 5 according to the invention. FIG. 7 is a waveform diagram illustrating an exemplary embodiment of an operation of the data skew compensating circuit 510 of FIG. 5 according to the invention when the negative data is delayed with respect to the positive data. FIG. 8 is a waveform diagram illustrating an exemplary embodiment of an operation of the data skew compensating circuit 510 of FIG. 5 according to the invention when the positive data is delayed with respect to the negative data.

Referring to FIGS. 1 to 8, the data driver 500 further includes the data skew compensating circuit 510 compared to the data driver 500-1 in FIGS. 2 and 3. The data skew compensating circuit 510 samples the positive data using the negative data and compensates the skew of the data signal DATA.

The data driver 500 may include a receiver equalizer 520 which receives the data signal DATA and compensate a gain of the data signal DATA, a clock-data restoring circuit 540 which generates a sampling clock to restore the received data signal DATA and restores the data signal DATA using the sampling clock, a digital to analog converter 560 which converts the restored data signal DATA to the analog data voltage and a data output buffer part 580 which outputs the analog data voltage to the display panel 100. In an exemplary embodiment, for example, when the display panel 100 includes N data lines DL1 to DLN, the data output buffer part 580 may include N output buffers OB1 to OBN.

In this exemplary embodiment, the data skew compensating circuit 510 is disposed between the transmission line which connects the timing controller 200 and the data driver 500 and the receiver equalizer 520.

The data skew compensating circuit 510 may include a data skew detector 512, a charge pump 514, a loop filter 516 and a voltage control delaying circuit 518.

The data skew detector 512 may compare the timing of the positive data POSITIVE DATA and the timing of the converted negative data NEGATIVE DATA_OUT to detect the skew of the data signal DATA. The data skew detector 512 may generate an increase signal UP and a decrease signal DOWN, specifically one of the increase signal UP and the decrease signal DOWN, based on the skew of the data signal DATA. In an exemplary embodiment, for example, the converted negative data NEGATIVE DATA_OUT may be an output signal of the voltage control delaying circuit 518.

The data skew detector 512 may include a plurality of flip flops to sample the positive data POSITIVE DATA using the converted negative data NEGATIVE DATA_OUT.

The data skew detector 512 may include a first D-flip flop DFF1, a second D-flip flop DFF2, a third D-flip flop DFF3 and a fourth D-flip flop DFF4. The first D-flip flop DFF1 may include a first input part receiving the positive data POSITIVE DATA, a second input part receiving the converted negative data NEGATIVE DATA_OUT and an output part outputting a first logic signal S1. The second D-flip flop DFF2 may include a first input part receiving the positive data POSITIVE DATA, a second input part receiving the converted negative data NEGATIVE DATA_OUT and an output part outputting a second logic signal S2. The third D-flip flop DFF3 may include a first input part receiving the first logic signal S1, a second input part receiving the converted negative data NEGATIVE DATA_OUT and an output part outputting a third logic signal S3. The fourth D-flip flop DFF4 may include a first input part receiving the second logic signal S2, a second input part receiving the converted negative data NEGATIVE DATA_OUT and an output part outputting a fourth logic signal S4.

The data skew detector 512 may further include a first XOR gate XOR1 receiving the first logic signal S1 and the third logic signal S3 and outputting the decrease signal DOWN and a second XOR gate XOR2 receiving the second logic signal S2 and the fourth logic signal S4 and outputting the increase signal UP.

In this exemplary embodiment, the data skew detector 512 may further include a fifth D-flip flop DFF5 and a sixth D-flip flop DFF6. The fifth D-flip flop DFF5 may include a first input part receiving the decrease signal DOWN which is the output signal of the first XOR gate XOR1, a second input part receiving a compensating clock signal LOW FREQ CLK and an output part outputting the decrease signal DOWN which is sampled using the compensating clock signal LOW FREQ CLK. The sixth D-flip flop DFF6 may include a first input part receiving the increase signal UP which is the output signal of the second XOR gate XOR2, a second input part receiving the compensating clock signal LOW FREQ CLK and an output part outputting the increase signal UP which is sampled using the compensating clock signal LOW FREQ CLK.

In a cycle of the compensating clock signal LOW FREQ CLK, the increase signal UP may be provided to the charge pump 514. In the cycle of the compensating clock signal LOW FREQ CLK, the decrease signal DOWN may be provided to the charge pump 514. A cycle to compensate the skew of the data signal DATA may be determined by the compensating clock signal LOW FREQ CLK.

The charge pump 514 may increase or decrease a voltage of a first node N1 based on the increase signal UP and the decrease signal DOWN.

The charge pump 514 may include a first switch SW1 operated in response to the increase signal UP, a first current source CS1 disposed between the first switch SW1 and a power voltage node VDD, a second switch SW2 operated in response to the decrease signal DOWN and a second current source CS2 disposed between the second switch SW2 and a ground.

When the increase signal UP is inputted from the data skew detector 512 to the charge pump 514, the first switch SW1 is turned on such that the voltage of the first node N1 increases. The first source CS1 may adjust the current flowing a path from the power voltage node VDD to the first node N1 such that increment of the voltage of the first node N1 may be adjusted.

When the decrease signal DOWN is inputted from the data skew detector 512 to the charge pump 514, the second switch SW2 is turned on such that the voltage of the first node N1 decreases. The second source CS2 may adjust the current flowing a path from the ground to the first node N1 such that decrement of the voltage of the first node N1 may be adjusted.

A buffer BP may be disposed between the charge pump 514 and the first node N1.

The loop filter 516 may maintain the voltage of the first node N1. The loop filter 516 may include a first capacitor CC including a first end connected to the first node N1 and a second end connected to a ground.

The voltage control delaying circuit 518 may delay the negative data NEGATIVE DATA to generate the converted negative data NEGATIVE DATA_OUT.

The voltage control delaying circuit 518 may include even-numbered inverter circuits connected to each other. Although the voltage control delaying circuit 518 includes six inverter circuits in FIG. 6, the inventive concept is not limited thereto.

Each of the inverter circuits may include two transistors connected to each other in series. A transistor of the two transistors connected to each other in series may be a P-type transistor and the other transistor of the two transistors may be an N-type transistor.

A first inverter circuit may include a first transistor T1 and a second transistor T2. The first transistor T1 includes a control electrode connected to a control electrode of the second transistor T2, an input electrode connected to the first node N1 and an output electrode connected to an input electrode of the second transistor T2. The second transistor T2 includes the control electrode connected to the control electrode of the first transistor T1, the input electrode connected to the output electrode of the first transistor T1 and an output electrode connected to a ground. The negative data NEGATIVE_DATA may be applied to the control electrodes of the first transistor T1 and the second transistor T2. The output signal of the first transistor T1 may be a signal inverted from the negative data NEGATIVE DATA.

A second inverter circuit may include a third transistor T3 and a fourth transistor T4. The third transistor T3 includes a control electrode connected to a control electrode of the fourth transistor T4, an input electrode connected to the first node N1 and an output electrode connected to an input electrode of the fourth transistor T4. The fourth transistor T4 includes the control electrode connected to the control electrode of the third transistor T3, the input electrode connected to the output electrode of the third transistor T3 and an output electrode connected to a ground. The output signal of the first transistor T1 may be applied to the control electrodes of the third transistor T3 and the fourth transistor T4. The output signal of the third transistor T3 may be the negative data NEGATIVE DATA.

A third inverter circuit may include a fifth transistor T5 and a sixth transistor T6. The fifth transistor T5 includes a control electrode connected to a control electrode of the sixth transistor T6, an input electrode connected to the first node N1 and an output electrode connected to an input electrode of the sixth transistor T6. The sixth transistor T6 includes the control electrode connected to the control electrode of the fifth transistor T5, the input electrode connected to the output electrode of the fifth transistor T5 and an output electrode connected to a ground. The output signal of the third transistor T3 may be applied to the control electrodes of the fifth transistor T5 and the sixth transistor T6. The output signal of the fifth transistor T5 may be a signal inverted from the negative data NEGATIVE DATA.

A fourth inverter circuit may include a seventh transistor T7 and an eighth transistor T8. The seventh transistor T7 includes a control electrode connected to a control electrode of the eighth transistor T8, an input electrode connected to the first node N1 and an output electrode connected to an input electrode of the eighth transistor T8. The eighth transistor T8 includes the control electrode connected to the control electrode of the seventh transistor T7, the input electrode connected to the output electrode of the seventh transistor T7 and an output electrode connected to a ground. The output signal of the fifth transistor T5 may be applied to the control electrodes of the seventh transistor T7 and the eighth transistor T8. The output signal of the seventh transistor T7 may be the negative data NEGATIVE DATA.

A fifth inverter circuit may include a ninth transistor T9 and a tenth transistor T10. A sixth inverter circuit may include an eleventh transistor T11 and a twelfth transistor T12. The fifth inverter circuit may be operated in the same way as the above explained first and third inverter circuits, and the sixth inverter circuit may be operated in the same way as the above explained second and fourth inverter circuits.

The timing of the negative data NEGATIVE DATA may be delayed when passing through the inverter circuits such that the converted negative data NEGATIVE DATA_OUT may be generated.

In FIG. 7, the transmission of the negative data NEGATIVE DATA is delayed with respect to the transmission of the positive data POSITIVE DATA. The initial converted negative data NEGATIVE DATA_OUT may be the same as a delayed signal of the negative data NEGATIVE DATA.

The first D-flip flop DFF1, the third D-flip flop DFF3 and the fourth D-flip flop DFF4 sample input signals applied to the first input parts to generate output signals, respectively, at a rising edge of a signal applied to the respective second input parts. In contrast, the second D-flip flop DFF2 samples an input signal applied to the first input part thereof to generate an output signal at a falling edge of a signal applied to the second input part thereof.

Since the positive data POSITIVE DATA has a low level at a first rising edge E1 of the converted negative data NEGATIVE DATA_OUT, the first logic signal S1 which is the output signal of the first D-flip flop DFF1 may have a low level.

Since the positive data POSITIVE DATA has a high level at a first falling edge E2 of the converted negative data NEGATIVE DATA_OUT, the second logic signal S2 which is the output signal of the second D-flip flop DFF2 may be changed to a high level from the first falling edge E2.

Since the first logic signal S1 has a low level at a second rising edge E3 of the converted negative data NEGATIVE DATA_OUT, the third logic signal S3 which is the output signal of the third D-flip flop DFF3 may have a low level.

Since the second logic signal S2 has a high level at a second rising edge E3 of the converted negative data NEGATIVE DATA_OUT, the fourth logic signal S4 which is the output signal of the fourth D-flip flop DFF4 may be changed to a high level from the second rising edge E3.

The decrease signal DOWN is a result of XOR operation of the first logic signal S1 and the third logic signal S3. Therefore, the decrease signal DOWN maintains a low level since the first and third logic signals S1 and S3 have a low level. The increase signal UP is a result of XOR operation of the second logic signal S2 and the fourth logic signal S4. Therefore, the increase signal UP has a high level between the first falling edge E2 and the second rising edge E3 of the converted negative data NEGATIVE DATA_OUT.

The voltage of the first node N1 increases in response to the increase signal UP. When the voltage of the first node N1 increases, the voltage control delaying circuit 518 generates the converted negative data NEGATIVE DATA_OUT which is generated by decreasing a delay of the negative data NEGATIVE DATA.

Since the delay of the negative data NEGATIVE DATA decreases, the timing of the converted negative data NEGATIVE DATA_OUT gradually becomes the same as the timing of the positive data POSITIVE DATA. When the timing of the converted negative data NEGATIVE DATA_OUT is the same as the timing of the positive data POSITIVE DATA, the increase signal UP becomes inactivated.

In FIG. 8, the transmission of the positive data POSITIVE DATA is delayed with respect to the transmission of the negative data NEGATIVE DATA. The initial converted negative data NEGATIVE DATA_OUT may be the same as a delayed signal of the negative data NEGATIVE DATA.

Since the positive data POSITIVE DATA has a high level at a first rising edge E1 of the converted negative data NEGATIVE DATA_OUT, the first logic signal S1 which is the output signal of the first D-flip flop DFF1 may be changed to a high level from the first rising edge E1.

Since the positive data POSITIVE DATA has a low level at a first falling edge E2 of the converted negative data NEGATIVE DATA_OUT, the second logic signal S2 which is the output signal of the second D-flip flop DFF2 may have a low level.

Since the first logic signal S1 has a high level at a second rising edge E3 of the converted negative data NEGATIVE DATA_OUT, the third logic signal S3 which is the output signal of the third D-flip flop may be changed to a high level from the second rising edge E3.

Since the second logic signal S2 has a low level at a second rising edge E3 of the converted negative data NEGATIVE DATA_OUT, the fourth logic signal S4 which is the output signal of the fourth D-flip flop may have a low level.

Since the increase signal UP is a result of XOR operation of the second logic signal S2 and the fourth logic signal S4. the increase signal UP maintains a low level. Since the decrease signal DOWN is a result of XOR operation of the first logic signal S1 and the third logic signal S3, the decrease signal DOWN has a high level between the first rising edge E1 and the second rising edge E3 of the converted negative data NEGATIVE DATA_OUT.

The voltage of the first node N1 decreases in response to the decrease signal DOWN. When the voltage of the first node N1 decreases, the voltage control delaying circuit 518 generates the converted negative data NEGATIVE DATA_OUT which is generated by increasing a delay of the negative data NEGATIVE DATA.

Since the delay of the negative data NEGATIVE DATA increases, the timing of the converted negative data NEGATIVE DATA_OUT gradually becomes the same as the timing of the positive data POSITIVE DATA. When the timing of the converted negative data NEGATIVE DATA_OUT is the same as the timing of the positive data POSITIVE DATA, the decrease signal DOWN becomes inactivated.

According to this exemplary embodiment, the data skew compensating circuit 510 compares the timing of the positive data POSITIVE DATA and the timing of the converted negative data NEGATIVE DATA_OUT to detect the skew, and matches the timing of the positive data POSITIVE DATA and the timing of the converted negative data NEGATIVE DATA_OUT using the increase signal UP or the decrease signal DOWN. Thus, the distortion of the data signal generated due to characteristics and performances of the transmitter driver 260 of the timing controller 200 and transmission differences between data transmitting paths CHP and CHN of the positive data and the negative data may be compensated by the data skew compensating circuit 510. In addition, the distortion of the data signal is compensated such that the display quality of the display panel 100 may be enhanced.

Figure 9:
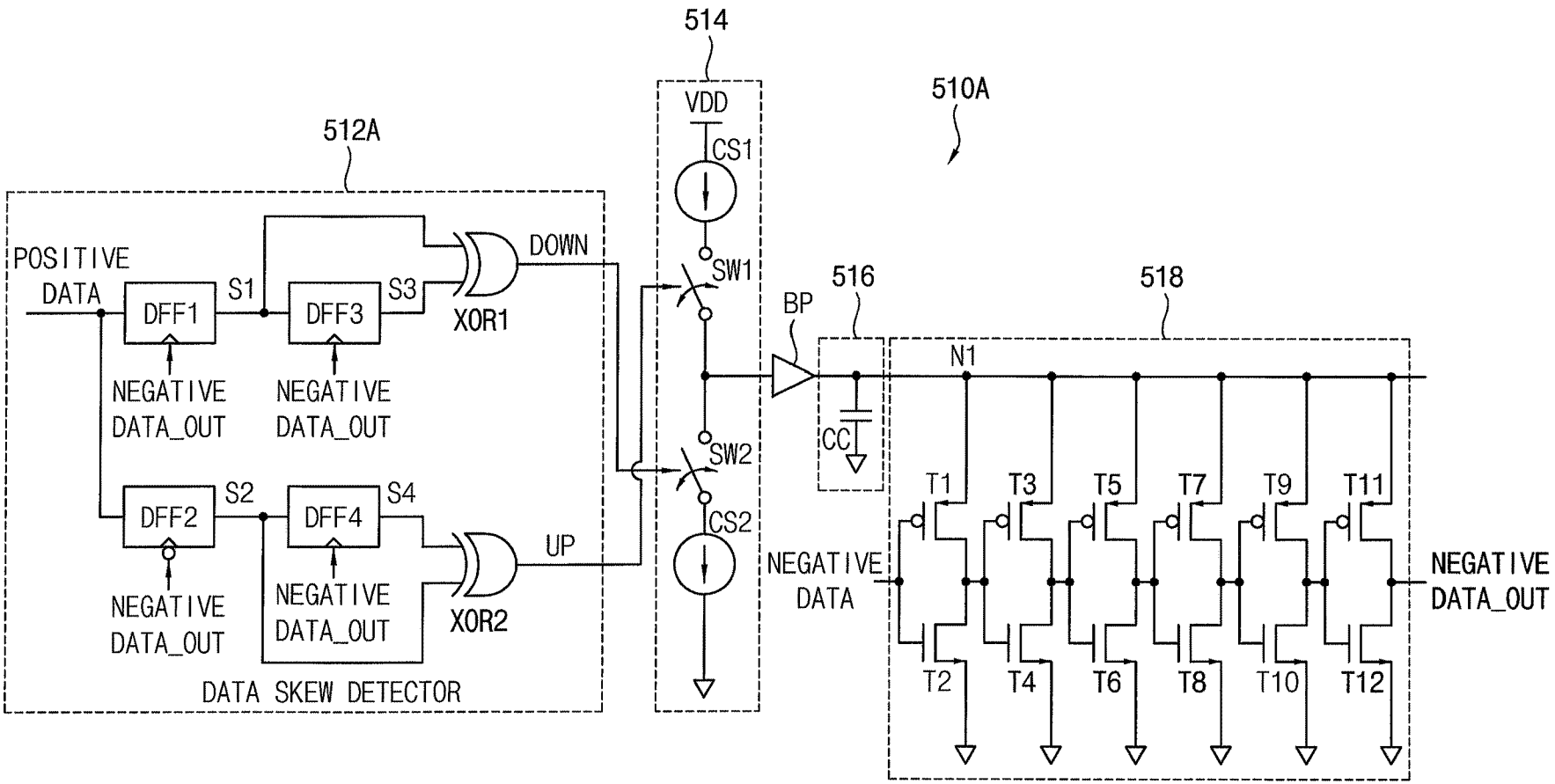
FIG. 9 is a circuit diagram illustrating another exemplary embodiment of a data skew compensating circuit according to the inventive concept.

FIG. 9 is a circuit diagram illustrating another exemplary embodiment of a data skew compensating circuit according to the inventive concept.

The data skew compensating circuit 510A according to this exemplary embodiment is substantially the same as the data skew compensating circuit 510 of the previous exemplary embodiment explained referring to FIGS. 6 to 8 except that the data skew detector 512A does not include a fifth D-flip flop and a sixth D-flip flop. Thus, the same reference numerals will be used to refer to the same or like parts as those described in the previous exemplary embodiment of FIGS. 6 to 8 and any repetitive explanation concerning the above elements will be omitted.

Referring to FIGS. 1, 5, 7 to 9, the display apparatus includes a display panel 100 and a display panel driver. The display panel driver includes a timing controller 200, a gate driver 300, a gamma reference voltage generator 400 and a data driver 500.

The data driver 500 includes a data skew compensating circuit 510A. The data skew compensating circuit 510A samples the positive data using the negative data to compensate the skew of the data signal DATA.

The data skew compensating circuit 510A may include a data skew detector 512A, a charge pump 514, a loop filter 516 and a voltage control delaying circuit 518.

The data skew detector 512A may compare the timing of the positive data POSITIVE DATA and the timing of the converted negative data NEGATIVE DATA_OUT to detect the skew of the data signal DATA. The data skew detector 512A may generate an increase signal UP and a decrease signal DOWN, specifically one of the increase signal UP and the decrease signal DOWN, based on the skew of the data signal DATA. In an exemplary embodiment, for example, the converted negative data NEGATIVE DATA_OUT may be an output signal of the voltage control delaying circuit 518.

The data skew detector 512A may include a plurality of flip flops to sample the positive data POSITIVE DATA using the converted negative data NEGATIVE DATA_OUT.

The data skew detector 512A may include a first D-flip flop DFF1, a second D-flip flop DFF2, a third D-flip flop DFF3 and a fourth D-flip flop DFF4. The first D-flip flop DFF1 may include a first input part receiving the positive data POSITIVE DATA, a second input part receiving the converted negative data NEGATIVE DATA_OUT and an output part outputting a first logic signal S1. The second D-flip flop DFF2 may include a first input part receiving the positive data POSITIVE DATA, a second input part receiving the converted negative data NEGATIVE DATA_OUT and an output part outputting a second logic signal S2. The third D-flip flop DFF3 may include a first input part receiving the first logic signal S1, a second input part receiving the converted negative data NEGATIVE DATA_OUT and an output part outputting a third logic signal S3. The fourth D-flip flop DFF4 may include a first input part receiving the second logic signal S2, a second input part receiving the converted negative data NEGATIVE DATA_OUT and an output part outputting a fourth logic signal S4.

The data skew detector 512A may further include a first XOR gate XOR1 receiving the first logic signal S1 and the third logic signal S3 and outputting the decrease signal DOWN and a second XOR gate XOR2 receiving the second logic signal S2 and the fourth logic signal S4 and outputting the increase signal UP.

In this exemplary embodiment, the data skew detector 512A may not include a fifth D-flip flop DFF5 in FIG. 6 which receives the output signal of the first XOR gate XOR1. In addition, the data skew detector 512A may not include a sixth D-flip flop DFF6 in FIG. 6 which receives the output signal of the second XOR gate XOR2.

When the fifth D-flip flop DFF5 and the sixth D-flip flop DFF6 are omitted, the data skew detector 512A provides the increase signal UP and the decrease signal DOWN to the charge pump 514 regardless of the compensating clock signal.

According to this exemplary embodiment, the data skew compensating circuit 510A compares the timing of the positive data POSITIVE DATA and the timing of the converted negative data NEGATIVE DATA_OUT to detect the skew, and gradually matches the timing of the positive data POSITIVE DATA and the timing of the converted negative data NEGATIVE DATA_OUT using the increase signal UP and the decrease signal DOWN. Thus, the distortion of the data signal generated due to characteristics and performances of the transmitter driver 260 of the timing controller 200 and transmission differences of data transmitting paths CHP and CHN of the positive data and the negative data may be compensated by the data skew compensating circuit 510A. In addition, the distortion of the data signal is compensated such that the display quality of the display panel 100 may be enhanced.

Figure 10:
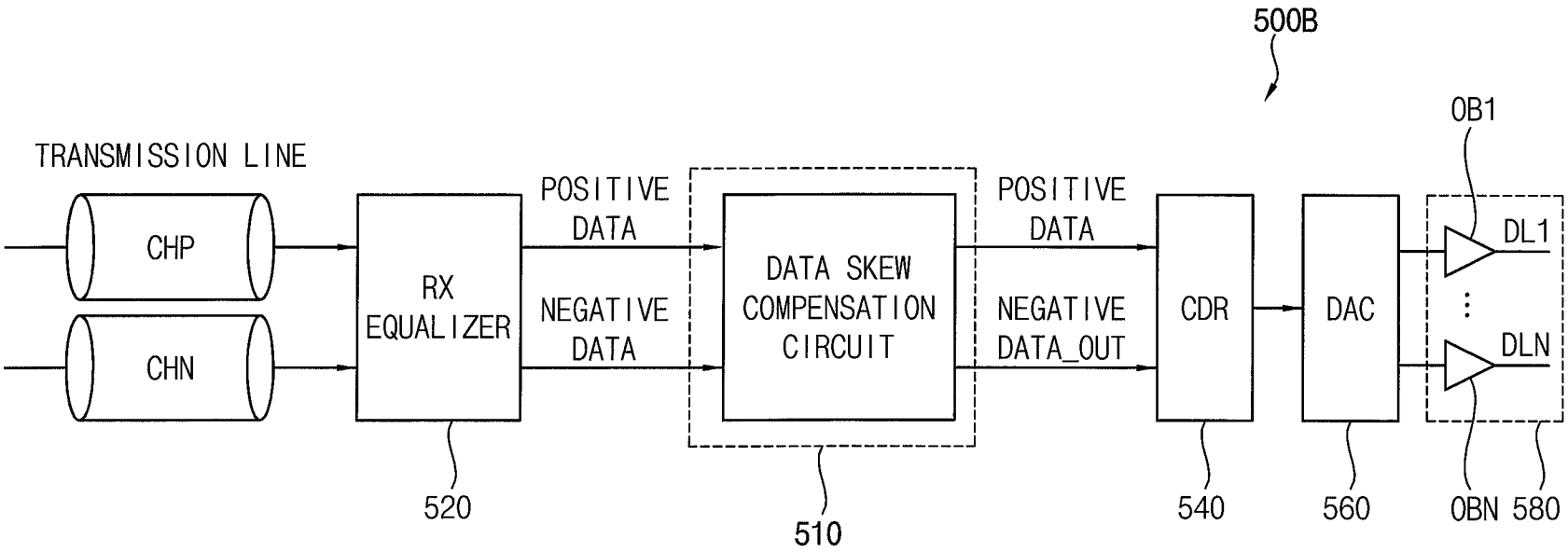
FIG. 10 is a block diagram illustrating another exemplary embodiment of a data driver including a data skew compensating circuit according to the inventive concept.

FIG. 10 is a block diagram illustrating another exemplary embodiment of a data driver including a data skew compensating circuit according to the inventive concept.

The data skew compensating circuit 500B according to this exemplary embodiment is substantially the same as the data skew compensating circuit 500 of the previous exemplary embodiment explained referring to FIGS. 5 to 8 except for the position of the data skew compensating circuit 510. Thus, the same reference numerals will be used to refer to the same or like parts as those described in the previous exemplary embodiment of FIGS. 5 to 8, and any repetitive explanation concerning the above elements will be omitted.

Referring to FIGS. 1, 6 to 8 and 10, the display apparatus includes a display panel 100 and a display panel driver. The display panel driver includes a timing controller 200, a gate driver 300, a gamma reference voltage generator 400 and a data driver 500B.

The data driver 500B includes a data skew compensating circuit 510. The data skew compensating circuit 510 samples the positive data using the negative data to compensate the skew of the data signal DATA.

The data driver 500B includes a receiver equalizer 520 which receives the data signal DATA and compensates a gain of the data signal DATA, a clock-data restoring circuit 540 which generates a sampling clock to restore the received data signal DATA and restores the data signal DATA using the sampling clock, a digital to analog converter 560 which converts the restored data signal DATA to the analog data voltage and a data output buffer part 580 which outputs the data voltage to the display panel 100. In an exemplary embodiment, for example, when the display panel 100 includes N data lines DL1 to DLN, the data output buffer part 580 may include N output buffers OB1 to OBN.

In this exemplary embodiment, the data skew compensating circuit 510 is disposed between the receiver equalizer 520 and the clock-data restoring circuit 540.

The data skew compensating circuit 510 may include a data skew detector 512, a charge pump 514, a loop filter 516 and a voltage control delaying circuit 518.

The data skew detector 512 may compare the timing of the positive data POSITIVE DATA and the timing of the converted negative data NEGATIVE DATA_OUT to detect the skew of the data signal DATA. The data skew detector 512 may generate an increase signal UP and a decrease signal DOWN based on the skew of the data signal DATA. In an exemplary embodiment, for example, the converted negative data NEGATIVE DATA_OUT may be an output signal of the voltage control delaying circuit 518.

The charge pump 514 may increase or decrease a voltage of a first node N1 based on one of the increase signal UP and the decrease signal DOWN.

The loop filter 516 may maintain the voltage of the first node N1. The loop filter 516 may include a first capacitor CC including a first end connected to the first node N1 and a second end connected to a ground.

The voltage control delaying circuit 518 may delay the negative data NEGATIVE DATA to generate the converted negative data NEGATIVE DATA_OUT.

According to this exemplary embodiment, the data skew compensating circuit 510 compares the timing of the positive data POSITIVE DATA and the timing of the converted negative data NEGATIVE DATA_OUT to detect the skew, and gradually matches the timing of the positive data POSITIVE DATA and the timing of the converted negative data NEGATIVE DATA_OUT using the increase signal UP and the decrease signal DOWN. Thus, the distortion of the data signal generated due to characteristics and performances of the transmitter driver 260 of the timing controller 200 and transmission differences of data transmitting paths CHP and CHN of the positive data and the negative data may be compensated. In addition, the distortion of the data signal is compensated so that the display quality of the display panel 100 may be enhanced.

According to the exemplary embodiments of the display panel driver and the display apparatus including the display panel driver, the accuracy of the data signal may be enhanced and the display quality of the display panel may be enhanced.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the present inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display panel driver comprising:

a timing controller which generates a data signal based on an input image data; and a data driver which receives the data signal, converts the data signal into a data voltage and outputs the data voltage to a display panel, wherein the data signal comprises positive data and negative data, and wherein the data driver comprises a data skew compensating circuit which samples the positive data using the negative data and compensates a skew of the data signal by comparing and matching a transmission timing of the positive data with a transmission timing of the negative data from the timing controller to the data driver.

2. The display panel driver of claim 1, wherein the data driver further comprises:

a receiver equalizer which receives the data signal and compensates a gain of the data signal;

a clock-data restoring circuit which generates a sampling clock to restore the data signal received from the receiver equalizer and restores the data signal using the sampling clock;

a digital to analog converter which converts the restored data signal to the data voltage; and a data output buffer part which outputs the data voltage to the display panel.

3. The display panel driver of claim 1, wherein the data skew compensating circuit comprises:

a data skew detector which compares a timing of the positive data and a timing of converted negative data to detect the skew of the data signal and generates one of an increase signal and a decrease signal based on the skew of the data signal;

a charge pump which increases or decreases a voltage of a first node based on the one of the increase signal and the decrease signal;

a loop filter which maintains the voltage of the first node; and a voltage control delaying circuit which delays the negative data and generates the converted negative data as a delayed signal of the negative data.

4. The display panel driver of claim 3, wherein the data skew detector comprises a plurality of flip flops which sample the positive data using the converted negative data.

5. The display panel driver of claim 4, wherein the plurality of data skew detector comprises:

a first D-flip flop comprising a first input part which receives the positive data, a second input part which receives the converted negative data and an output part which outputs a first logic signal;

a second D-flip flop comprising a first input part which receives the positive data, a second input part which receives the converted negative data and an output part which outputs a second logic signal;

a third D-flip flop comprising a first input part which receives the first logic signal, a second input part which receives the converted negative data and an output part which outputs a third logic signal; and a fourth D-flip flop comprising a first input part which receives the second logic signal, a second input part which receives the converted negative data and an output part which outputs a fourth logic signal, and wherein the data skew detector further comprises:

a first XOR gate which receives the first logic signal and the third logic signal, and a second XOR gate which receives the second logic signal and the fourth logic signal.

6. The display panel driver of claim 5, wherein the data skew detector further comprises:

a fifth D-flip flop comprising a first input part which receives the decrease signal which is an output signal of the first XOR gate, a second input part which receives a compensated clock signal and an output part which outputs the decrease signal which is sampled by the compensated clock signal; and a sixth D-flip flop comprising a first input part which receives the increase signal which is an output signal of the second XOR gate, a second input part which receives the compensated clock signal and an output part which outputs the increase signal which is sampled by the compensated clock signal.

7. The display panel driver of claim 3, wherein the charge pump comprises:

a first switch which is operated in response to the increase signal;

a first current source disposed between the first switch and a power voltage node;

a second switch which is operated in response to the decrease signal; and a second current source disposed between the second switch and a ground.

8. The display panel driver of claim 3, wherein the loop filter comprises a first capacitor including a first end connected to the first node and a second end connected to a ground.

9. The display panel driver of claim 3, wherein the voltage control delaying circuit comprises even-numbered inverter circuits connected to each other.

10. The display panel driver of claim 9, wherein the inverter circuit comprises a first transistor and a second transistor connected to each other in series, and wherein the first transistor comprises a control electrode connected to a control electrode of the second transistor, an input electrode connected to the first node and an output electrode connected to an input electrode of the second transistor, and the second transistor comprises the control electrode connected to the control electrode of the first transistor, the input electrode connected to the output electrode of the first transistor and an output electrode connected to a ground.

11. The display panel driver of claim 2, wherein the data skew compensating circuit is disposed between a transmitting path connecting the timing controller and the data driver and the receiver equalizer.

12. The display panel driver of claim 2, wherein the data skew compensating circuit is disposed between the receiver equalizer and the clock-data restoring circuit.

13. A display apparatus comprising:

a display panel which displays an image;

a timing controller which generates a first control signal and a second control signal based on an input control signal and generates a data signal based on input image data;

a gate driver which receives the first control signal, generates a gate signal in response to the first control signal and provides the gate signal to the display panel; and a data driver which receives the second control signal and the data signal, converts the data signal to a data voltage in response to the second control signal and provides the data voltage to the display panel, wherein the data signal comprises positive data and negative data, and wherein the data driver comprises a data skew compensating circuit which samples the positive data using the negative data and compensates a skew of the data signal by comparing and matching a transmission timing of the positive data with a transmission timing of the negative data from the timing controller to the data driver.

14. The display apparatus of claim 13, wherein the data driver further comprises:

a receiver equalizer which receives the data signal and compensates a gain of the data signal;

a clock-data restoring circuit which generates a sampling clock to restore the data signal received from the receiver equalizer and restores the data signal using the sampling clock;

a digital to analog converter which converts the restored data signal to the data voltage; and a data output buffer part which outputs the data voltage to the display panel.

15. The display apparatus of claim 13, wherein the data skew compensating circuit comprises:

a data skew detector which compares a timing of the positive data and a timing of converted negative data to detect the skew of the data signal and generates one of an increase signal and a decrease signal based on the skew of the data signal;

a charge pump which increases or decreases a voltage of a first node based on the one of the increase signal and the decrease signal;

a loop filter which maintains the voltage of the first node; and a voltage control delaying circuit which delays the negative data and generates the converted negative data as a delayed signal of the negative data.

16. The display apparatus of claim 15, wherein the data skew detector comprises a plurality of flip flops which sample the positive data using the converted negative data.

17. The display apparatus of claim 16, wherein the plurality of data skew detector comprises:

a first D-flip flop comprising a first input part which receives the positive data, a second input part which receives the converted negative data and an output part which outputs a first logic signal;

a second D-flip flop comprising a first input part which receives the positive data, a second input part which receives the converted negative data and an output part which outputs a second logic signal;

a third D-flip flop comprising a first input part which receives the first logic signal, a second input part which receives the converted negative data and an output part which outputs a third logic signal; and a fourth D-flip flop comprising a first input part which receives the second logic signal, a second input part which receives the converted negative data and an output part which outputs a fourth logic signal, and wherein the data skew detector further comprises:

a first XOR gate which receives the first logic signal and the third logic signal, and a second XOR gate which receives the second logic signal and the fourth logic signal.

18. The display apparatus of claim 17, wherein the data skew detector comprises:

a fifth D-flip flop comprising a first input part which receives the decrease signal which is an output signal of the first XOR gate, a second input part which receives a compensated clock signal and an output part which outputs the decrease signal which is sampled by the compensated clock signal; and a sixth D-flip flop comprising a first input part which receives the increase signal which is an output signal of the second XOR gate, a second input part which receives the compensated clock signal and an output part which outputs the increase signal which is sampled by the compensated clock signal.

19. The display apparatus of claim 15, wherein the charge pump comprises:

a first switch which is operated in response to the increase signal;

a first current source disposed between the first switch and a power voltage node;

a second switch which operated in response to the decrease signal; and a second current source disposed between the second switch and a ground.

20. The display apparatus of claim 15, wherein the voltage control delaying circuit includes even-numbered inverter circuits connected to each other.

* * * * *